United States Patent [19]

Freermann

[11] 4,450,780

[45] May 29, 1984

[54] FEEDER FOR AUTOMATIC SELVEDGING APPARATUS

[75] Inventor: Johannes Freermann, Ochtrup, Fed. Rep. of Germany

[73] Assignee: Carl Schmale KG, Ochtrup, Fed. Rep. of Germany

[21] Appl. No.: 507,869

[22] Filed: Jun. 24, 1983

[30] Foreign Application Priority Data

Jul. 21, 1982 [DE] Fed. Rep. of Germany ..... 3227197

[51] Int. Cl.[3] ..... D05B 35/00

[52] U.S. Cl. ..... 112/147; 112/153; 112/306

[58] Field of Search ..... 112/153, 147, 136, 152, 112/306, 150, 141, 148

[56] References Cited

U.S. PATENT DOCUMENTS

| | | | |
|---|---|---|---|
| 2,546,831 | 3/1951 | Newell | 112/147 X |
| 2,619,057 | 11/1952 | Ellis, Sr. | 112/306 |
| 3,012,603 | 12/1961 | Newsone et al. | 112/147 X |
| 3,360,262 | 12/1967 | Kekopoulos et al. | 112/306 X |
| 3,463,482 | 8/1969 | Baron et al. | 112/147 X |
| 3,610,493 | 10/1971 | Brocklehurst | 112/306 X |

FOREIGN PATENT DOCUMENTS

| | | | |
|---|---|---|---|
| 2509506 | 9/1976 | Fed. Rep. of Germany | 112/153 |

*Primary Examiner*—H. Hampton Hunter
*Attorney, Agent, or Firm*—Karl F. Ross; Herbert Dubno

[57] ABSTRACT

An automatic selvedger has a pair of longitudinally spaced and transversely throughgoing main rolls rotatable about respective parallel axes and guides and a drive that pass the web longitudinally and continuously from one of the main rolls to the other main roll in a travel direction perpendicular to the roll axes and with the web spanned tightly longitudinally between the main rolls and lying generally in a plane with its edges generally parallel. The web edges are folded over between the upstream and the downstream main roll and then are stitched together. A feed device has at least one straight guide spaced upstream from and substantially parallel to the upstream main roll. The web passes over the guide and thence to the upstream main roll. A support between the guide and the upstream roll is pivotal about an axis transverse to a plane defined by the straight guide and upstream main roll axis. An upstream and a downstream deflecting roll carried on the support are rotatable about respective at least generally parallel axes flanking the support axis. The web is spanned over and passes between the deflecting rolls. The support is pivoted with the deflecting rolls about the support axis for laterally deflecting the web thereat.

8 Claims, 3 Drawing Figures

FEEDER FOR AUTOMATIC SELVEDGING APPARATUS

FIELD OF THE INVENTION

The present invention relates to an automatic selvedging apparatus. More particularly this invention concerns a device for continuously feeding a web to be selvedged to such an apparatus.

BACKGROUND OF THE INVENTION

An automatic selvedging apparatus, such as described in my jointly filed U.S. patent application Ser. No. 507,868 or in German patent document No. 2,509,506 automatically folds over and stitches the longitudinally extending and transversely spaced edges of an elongated textile web. This apparatus comprises a pair of longitudinally spaced and transversely throughgoing main rolls rotatable about respective parallel axes and guide/drive means for passing the web longitudinally and continuously from one of the main rolls to the other main roll in a travel direction perpendicular to the roll axes and with the web spanned tightly longitudinally between the main rolls and lying generally in a plane with its edges generally parallel. Means is provided between the upstream and the downstream main roll for folding over the edges of the web and sewing means between the folding means and the downstream main roll stitches together the folded-over web edges.

As described in the above-mentioned German patent document, the main rolls have web-engaging surfaces that are textured like velvet, that is not smooth. This surface texturing prevents the web from creeping transversely, by which is here meant across its warp and displacement direction but in the plane of the web and parallel to the weft. The device which feeds the web to such an arrangement must position it exactly on the upstream main roll, or one web edge will be folded over too much while the other edge is not folded enough and even not stitched. Typically it is necessary to use edge guides and relatively low tension, necessitating slow transport speed, to maintain the position accurately, and this style of operation is slow and not foolproof.

OBJECTS OF THE INVENTION

It is therefore an object of the present invention to provide an improved feed apparatus for an automatic selvedger.

Another object is the provision of such a feed apparatus for an automatic selvedger which overcomes the above-given disadvantages, that is which accurately feeds the web to the upstream main roll even at high speed.

A further object is to provide such an apparatus which can even correct web position while the selvedger is running.

SUMMARY OF THE INVENTION

A feed apparatus according to the invention coacts with an automatic selvedger of the type described above, that is having a pair of longitudinally spaced and transversely throughgoing main rolls rotatable about respective parallel axes and guides and a drive that pass the web longitudinally and continuously from one of the main rolls to the other main roll in a travel direction perpendicular to the roll axes and with the web spanned tightly longitudinally between the main rolls and lying generally in a plane with its edges generally parallel.

The web edges are folded over between the upstream and the downstream main roll and then are stitched together. The feed device according to the invention has at least one straight guide spaced upstream from and substantially parallel to the upstream main roll. The web passes over the guide and thence to the upstream main roll. A support between the guide and the upstream roll is pivotal about an axis transverse to a plane defined by the straight guide and upstream main roll axis. An upstream and a downstream deflecting roll carried on the support are rotatable about respective at least generally parallel axes flanking the support axis. The web is spanned over and passes between the deflecting rolls. The support is pivoted with the deflecting rolls about the support axis for laterally deflecting the web thereat.

With this system it is possible to correct the transverse position of the web even when same is moving at high speed. A severe offset between the position upstream of the aligning device of this invention and the upstream roll can be compensated for easily without unduly stressing or tensioning the web. It is also possible to provide another such support and deflecting-roll unit upstream for coarse edge adjustment, followed by fine adjustment at the downstream unit.

According to this invention the support axis is substantially perpendicular to the plane. Normally it is also perpendicular to the plane of the deflecting-roll axes and equispaced therebetween.

The deflecting rolls in accordance with this invention, are of the same diameter and axial length. This length is greater than the web width. In addition each deflecting roll can be formed of a succession of coaxial and axially succeeding cylinder sections of like diameter and rotatable independently of one another. The holder is U-shaped.

The apparatus further has means for detecting the position of the web edges between the main rolls and connected to the support for pivoting same and thereby adjusting web position. Thus feedback can be used to ensure constant position correction. As mentioned above a second sensor and aligning unit can be provided further upstream for coarse position adjustment. Even if the web moves during operation of the machine, therefore, the aligner can correct and malpositioning.

DESCRIPTION OF THE DRAWING

The above and other features and advantages will become more readily apparent from the following, reference being made to the accompanying drawing in which.

SPECIFIC DESCRIPTION

Figure 1:
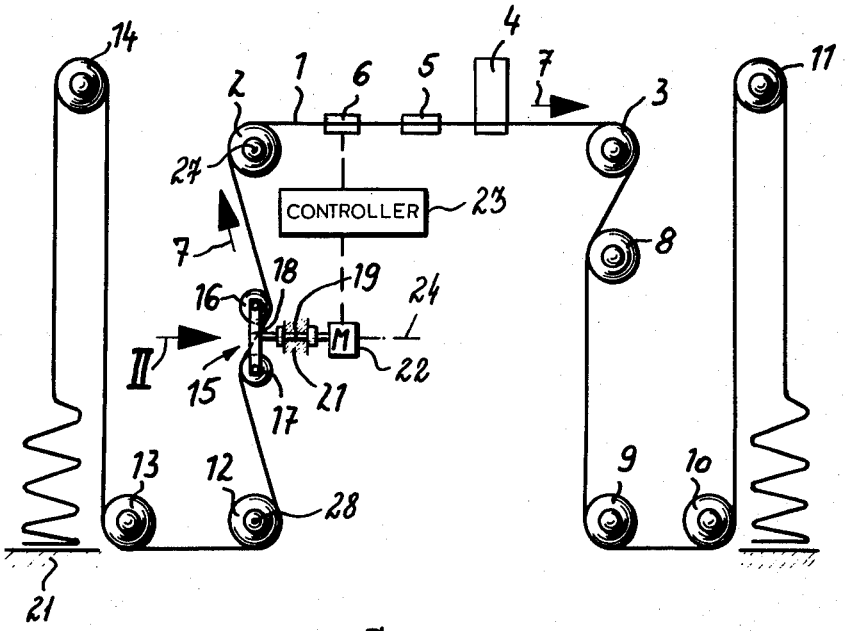
FIG. 1 is a side partly diagrammatic view of the apparatus according to this invention.

As seen in the drawing a terrycloth web 1 is spanned between horizontal and transversely throughgoing main rolls 2 and 3 so as to lie between these rolls 2 and 3 in a horizontal plane above and parallel to their axes which themselves are parallel and horizontal. The web 2 is not centrally supported between the rolls 2 and 3, however. In this working stretch defined by the rolls 2 and 3 the positions of the web edges are detected by standard photocell units 6, then folded over by folders 5, and then sewn by stitchers 4. The devices 4 and 5 are well known in the art and need no specific discussion here.

Figure 2:
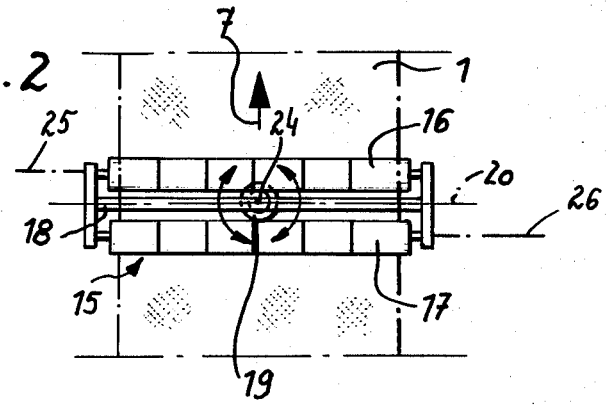
FIG. 2 is a detail view taken in the direction of arrow II of FIG. 1.

Upstream of the upstream main roller 2 the web 1 starts out folded up on a stationary support 21, then passes up and over an upstream drive roller 14, then down and under two further rolls 13 and 12, to rise up to the upstream main roll 2. A drive including a motor illustrated at 21 in FIGS. 2 and 4 is connected to these rolls 2, 12, 13, and 14 to rotate them at the same relatively slow peripheral speed. Similarly downstream from the downstram main roll 3 the web 1 passes around a roller 8 and then under two small deflecting rolls 9 and 10, then up over another roll 11 to be deposited in a folded pile. These rolls 3, 8, 9, 10 and 11 are driven at the same relatively fast transport speed to move the web 1 in the direction 7 and tension it longitudinally. It is also simply possible to brake the upstream drive rolls 2, 12, 13, and 14 slightly to longitudinally tension the web 1.

Immediately upstream of the upstream main drive roll 2 is an alignment device 15 comprising a pair of identical rolls 16 and 17 which are supported on a U-shaped mount 18 for rotation about respective parallel axes lying in a vertical plane and flanking a horizontal symmetry plane 20. These rolls 16 and 17, like the rolls 2 and 3, are of an axial length substantially greater than the workpiece width to allow the web 1 to move laterally on them as will be described below. The yoke mount 18 in turn is carried on a shaft 19 journaled in the support 21 for rotation about an axis 24 lying in the plane 20 and perpendicular to the plane of the axes 25 and 26 of the rolls 16 and 17. The web 1 describes an S-shaped path as it passes from the upstream roller 12 to the main roller 2, moving to one side around and over the lower roll 17, then through the nip between this roll 17 and the upper roll 16, and then under and around this upper roll 16 to the other side. If the axes 25 and 26 of the rolls 16 and 17 are perfectly horizontal and parallel to the axes 27 and 28 of the two rolls 2 and 12 flanking them, the web 1 leaves contact with the upper roll 16 with its edges vertically exactly above its edges where they enter contact with the lower roll 17. If, however, the roll unit 17–19 is tipped about the axis 24 so the axes 25 and 26 of the rolls 16 and 17 are not parallel to the axes 27 and 28 of the rolls 2 and 12, the web 1 will be deflected laterally, to a side depending on which way the unit 17–19 is tipped.

Figure 3:
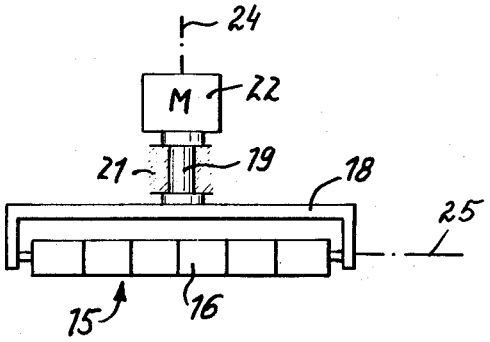
FIG. 3 is a top view of the detail shown in FIG. 2.

The rolls 16 and 17 are each actually formed of a succession of identical cylindrical sections which can rotate about the respective axes 25 and 26 independently of each other and which meet at 29 as indicated in FIG. 3.

A motor 22 operated by a controller 23 connected to the edge detectors 6 establishes the angular position of the rolls 16 and 17 about the axis 24 in accordance with the edge positions detected thereby. Thus when the web edges detected by the sensors 6 move from a predetermined position, in which they can be perfectly folded over and stitched, the controller 23 appropriately operates the aligner 15 to tip the roll unit 16–18 and return the web edges to the desired position.

In this manner perfect stitching of selvedges is possible even at very high throughput speeds.

I claim:

1. In combination with an apparatus which folds over and stitches the longitudinally extending and transversely spaced edges of an elongated textile web, and which comprises:

a pair of longitudinally spaced and transversely throughgoing main rolls rotatable about respective parallel axes;

guide and drive means for passing the web longitudinally and continuously from one of the main rolls to the other main roll in a travel direction perpendicular to the roll axes and with the web spanned tightly longitudinally between the main rolls and lying generally in a plane with its edges generally parallel;

means between the upstream and the downstream main roll for folding over the edges of the web; and sewing means between the folding means and the downstream main roll for stitching together the folded-over web edges;

a feeding apparatus comprising:

at least one straight guide spaced upstream from and substantially parallel to the upstream main roll, the web passing over the guide and thence to the upstream main roll;

a support between the guide and the upstream roll and pivotal about an axis transverse to a plane defined by the straight guide and upstream main roll axis;

an upstream and a downstream deflecting roll carried on the support and rotatable about respective at least generally parallel axes flanking the support axis, the web being spanned over and passing between the deflecting rolls; and means for pivoting the support and deflecting rolls about the support axis for laterally deflecting the web thereat.

2. The feeding apparatus defined in claim 1 wherein the support axis is substantially perpendicular to the plane.

3. The feeding apparatus defined in claim 2 wherein the deflecting rolls are of substantially the same diameter.

4. The feeding apparatus defined in claim 3 wherein the deflecting rolls are of substantially the same axial length.

5. The feeding apparatus defined in claim 1 wherein each of the deflecting rolls is formed of a succession of coaxial and axially succeeding cylinder sections of like diameter and rotatable independently of one another.

6. The feeding apparatus defined in claim 1 wherein the holder is U-shaped.

7. The feeding apparatus defined in claim 1, further comprising:

means for detecting the position of the web edges between the main rolls and connected to the support for pivoting same and thereby adjusting web position.

8. The feed apparatus defined in claim 1 wherein the the deflecting-roll axes define a plane perpendicular to the support axis and the support axis is equidistant between the deflecting-roll axes.

* * * * *